US010324393B2

(12) United States Patent
Tsujihiro

(10) Patent No.: US 10,324,393 B2
(45) Date of Patent: Jun. 18, 2019

(54) POSITIVELY CHARGEABLE TONER

(71) Applicant: KYOCERA Document Solutions Inc., Osaka (JP)

(72) Inventor: Masami Tsujihiro, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/125,797

(22) Filed: Sep. 10, 2018

(65) Prior Publication Data

US 2019/0086828 A1 Mar. 21, 2019

(30) Foreign Application Priority Data

Sep. 20, 2017 (JP) ..... 2017-179840

(51) Int. Cl.
*G03G 9/097* (2006.01)

(52) U.S. Cl.
CPC ..... *G03G 9/09775* (2013.01); *G03G 9/09708* (2013.01); *G03G 9/09725* (2013.01)

(58) Field of Classification Search
CPC ..... G03G 9/09775; G03G 9/09708; G03G 9/09725
See application file for complete search history.

(56) References Cited

U.S. PATENT DOCUMENTS

2017/0003613 A1* 1/2017 Kida ..... G03G 9/09708

FOREIGN PATENT DOCUMENTS

JP 2015-055857 A 3/2015

* cited by examiner

*Primary Examiner* — Thorl Chea
(74) *Attorney, Agent, or Firm* — Studebaker & Brackett PC

(57) ABSTRACT

A positively chargeable toner includes a plurality of toner particles. Each of the toner particles includes a toner mother particle and an external additive adhering to a surface of the toner mother particle. The external additive includes a plurality of resin particles. Each of the resin particles has a resin mother particle and a coat layer covering at least a portion of a surface of the resin mother particle. The coat layer contains a specific vinyl resin.

9 Claims, 1 Drawing Sheet

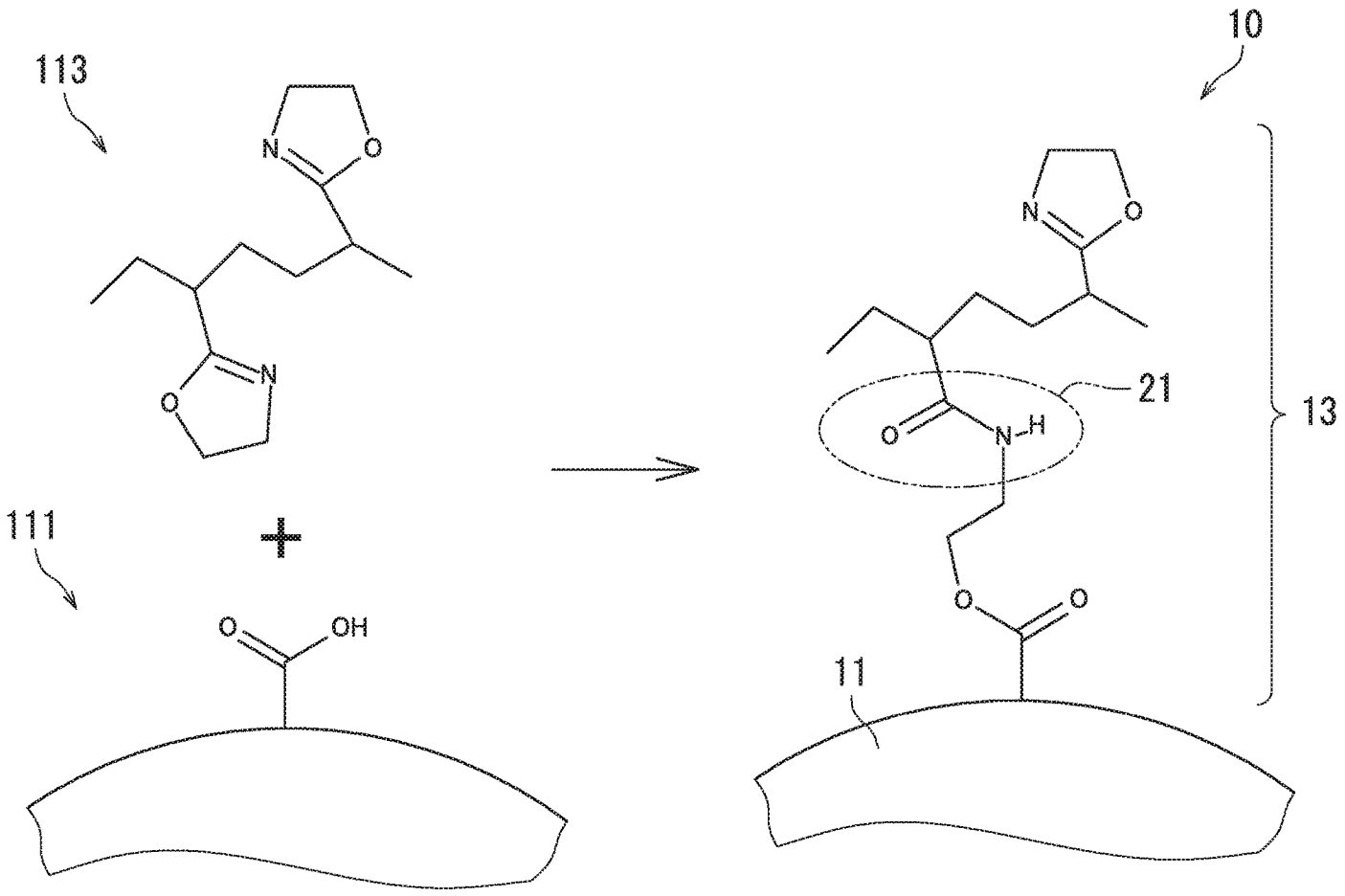
10
13
21
11
113
111

POSITIVELY CHARGEABLE TONER

INCORPORATION BY REFERENCE

The present application claims priority under 35 U.S.C. § 119 to Japanese Patent Application No. 2017-179840, filed on Sep. 20, 2017. The contents of this application are incorporated herein by reference in their entirety.

BACKGROUND

The present disclosure relates to a positively chargeable toner.

In order to improve fluidity and chargeability of a toner, it has been proposed that an external additive be added onto surfaces of toner mother particles. For example, an external additive including a plurality of fine resin particles having a core-shell structure is known. A shell layer of each of the fine resin particles contains a condensation product (a resin) of formaldehyde with a compound having at least two amino groups.

SUMMARY

A positively chargeable toner according to an aspect of the present disclosure includes a plurality of toner particles. Each of the toner particles includes a toner mother particle and an external additive adhering to a surface of the toner mother particle. The external additive includes a plurality of resin particles. Each of the resin particles has a resin mother particle and a coat layer covering at least a portion of a surface of the resin mother particle. The coat layer contains a vinyl resin. The vinyl resin includes a constitutional unit represented by formula (1-1) shown below and a constitutional unit represented by formula (1-2) shown below.

(1-1)

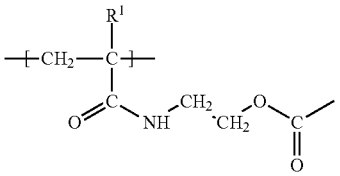

$R^1$ in formula (1-1) represents a hydrogen atom or an alkyl group optionally substituted with a substituent. An available bond of a carbon atom bonded to two oxygen atoms in formula (1-1) is bonded to an atom forming a resin contained in the resin mother particles.

(1-2)

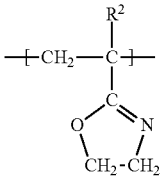

$R^2$ in formula (1-2) represents a hydrogen atom or an alkyl group optionally substituted with a substituent.

BRIEF DESCRIPTION OF THE DRAWINGS

FIGURE schematically illustrates a process in a method of resin particle preparation according to an embodiment of the present disclosure.

DETAILED DESCRIPTION

The following describes an embodiment of the present disclosure. Unless otherwise stated, evaluation results (for example, values indicating shape and physical properties) for particles are number averages of values measured for a suitable number of particles selected from among the particles of interest. Examples of particles include toner mother particles, an external additive, and a toner. The term "toner mother particles" means toner particles having no external additive.

A number average particle diameter of particles is a number average value of equivalent circle diameters of primary particles of the particles (diameters of circles having the same areas as projected areas of the particles) measured using a microscope, unless otherwise stated. A value for a volume median diameter ($D_{50}$) of particles is measured based on the Coulter principle (electrical sensing zone technique) using "Coulter Counter Multisizer 3", product of Beckman Coulter, Inc., unless otherwise stated.

An acid value and a hydroxyl value are measured in accordance with "Japanese Industrial Standard (JIS) K0070-1992", unless otherwise stated. Values for a number average molecular weight (Mn) and a mass average molecular weight (Mw) are measured by gel permeation chromatography, unless otherwise stated. Values for a glass transition point (Tg) and a melting point (Mp) are measured using a differential scanning calorimeter ("DSC-6220", product of Seiko Instruments Inc.), unless otherwise stated. A value for a softening point (Tm) is measured using a capillary rheometer ("CFT-500D", product of Shimadzu Corporation), unless otherwise stated.

The term "-based" may be appended to the name of a chemical compound in order to form a generic name encompassing both the chemical compound itself and derivatives thereof. Also, when the term "-based" is appended to the name of a chemical compound used in the name of a polymer, the term indicates that a constitutional unit of the polymer originates from the chemical compound or a derivative thereof. The term "(meth)acryl" may be used as a generic term for both acryl and methacryl.

Strength of chargeability is equivalent to ease of triboelectric charging, unless otherwise stated. A toner can for example be triboelectrically charged by mixing and stirring the toner with a standard carrier (anionic standard carrier: N-01, cationic standard carrier: P-01) provided by The Imaging Society of Japan. Surface potential of toner particles is measured before and after the triboelectric charging using for example a kelvin probe force microscope (KFM). A toner particle having a larger change in potential before and after the triboelectric charging has higher chargeability.

A positively chargeable toner having excellent charge stability means a positively chargeable toner having the following first to third characteristics. The first characteristic is that the positively chargeable toner has a sharp charge amount distribution. The second characteristic is that the positively chargeable toner can be maintained at a desired amount of charge upon initiation of image formation using the positively chargeable toner. The third characteristic is that the positively chargeable toner can be maintained at a desired amount of charge during continuous image formation using the positively chargeable toner.

A positively chargeable toner according to the present embodiment is an electrostatic latent image developing toner that can be favorably used in development of electrostatic latent images. The positively chargeable toner according to the present embodiment can be used as a one-component developer or mixed with a carrier to be used as a two-component developer. The positively chargeable toner that is used as a one-component developer is positively charged by friction with a development sleeve or a toner charging member in a development device. The toner charging member is for example a doctor blade. The positively chargeable toner that is mixed with a carrier and used as a two-component developer is positively charged by friction with the carrier in a development device.

The positively chargeable toner according to the present embodiment can for example be used in image formation in an electrophotographic apparatus (image forming apparatus). The following describes an example of image forming methods that are performed by an electrophotographic apparatus.

First, an electrostatic latent image is formed on a photosensitive layer of a photosensitive member based on image data. Next, the formed electrostatic latent image is developed using the positively chargeable toner (developing step). In the developing step, a development device supplies the positively chargeable toner on a development sleeve to the photosensitive layer of the photosensitive drum, and the positively chargeable toner adheres to the electrostatic latent image through electric force. Thus, the electrostatic latent image is developed to form a toner image on the photosensitive layer of the photosensitive drum. Subsequently, the toner image is transferred onto a recording medium (for example, paper), and then fixed to the recording medium by application of heat. As a result, an image is formed on the recording medium.

[Basic Features of Positively Chargeable Toner]

The positively chargeable toner according to the present embodiment has the following features (also referred to below as "basic features"). Specifically, the positively chargeable toner according to the present embodiment includes a plurality of toner particles. Each of the toner particles includes a toner mother particle and an external additive. The external additive includes a plurality of resin particles and adheres to surfaces of the toner mother particles.

Each of the resin particles has a resin mother particle and a coat layer. The resin mother particle contains a resin. The coat layer contains a vinyl resin and covers at least a portion of a surface of the resin mother particle.

Generally, a vinyl resin is a homopolymer or a copolymer including a vinyl compound. The vinyl compound has at least one functional group selected from a vinyl group ($CH_2$═CH—), a vinylidene group ($CH_2$═C<), and a vinylene group (—CH═CH—) in a molecule thereof. The vinyl compound forms a macromolecule (vinyl resin) through an addition polymerization involving cleavage of carbon-to-carbon double bonds (C═C) in molecules of the functional group such as the vinyl group.

According to the present embodiment, the vinyl resin contained in the coat layers includes a constitutional unit represented by formula (1-1) shown below (referred to below as a "constitutional unit (1-1)") and a constitutional unit represented by formula (1-2) shown below (referred to below as a "constitutional unit (1-2)"). The vinyl resin including the constitutional units (1-1) and (1-2) is referred to below as a "specific vinyl resin".

(1-1)

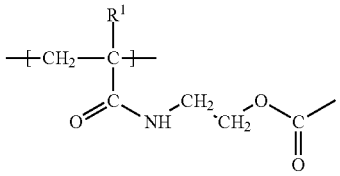

In formula (1-1), $R^1$ represents a hydrogen atom or an alkyl group optionally substituted with a substituent. The alkyl group may be a straight chain alkyl group, a branched chain alkyl group, or a ring alkyl group. The alkyl group optionally substituted with a substituent is for example a phenyl group. Preferably, $R^1$ represents a hydrogen atom, a methyl group, an ethyl group, or an isopropyl group. An available bond of a carbon atom bonded to two oxygen atoms in formula (1-1) is bonded to an atom forming the resin contained in the resin mother particles.

(1-2)

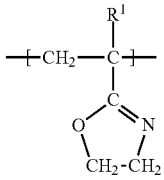

In formula (1-2), $R^2$ represents a hydrogen atom or an alkyl group optionally substituted with a substituent. The alkyl group may be a straight chain alkyl group, a branched chain alkyl group, or a ring alkyl group. The alkyl group optionally substituted with a substituent is for example a phenyl group. Preferably, $R^2$ represents a hydrogen atom, a methyl group, an ethyl group, or an isopropyl group.

As described above, the coat layers according to the present embodiment contain the specific vinyl resin. The specific vinyl resin includes the constitutional unit (1-2). The constitutional unit (1-2) includes a non-ring-opened oxazoline group. The non-ring-opened oxazoline group has a ring structure and is highly positively chargeable. It is therefore possible to provide a toner having excellent positive chargeability through the coat layers containing the specific vinyl resin.

The specific vinyl resin also includes the constitutional unit (1-1). The available bond of the carbon atom bonded to the two oxygen atoms in the constitutional unit (1-1) is bonded to an atom forming the resin contained in the resin mother particles. It is therefore possible to prevent the coat layers from coming off surfaces of the resin mother particles even when subjected to image formation continued over a long period of time. Consequently, it is possible to provide a toner having excellent positive chargeability. That is, it is possible to provide a positively chargeable toner having excellent charge stability.

Since the specific vinyl resin includes the constitutional unit (1-1), the coat layers can be prevented from having an excessively large thickness. For example, the coat layers can be restricted to a thickness of no greater than 3.0 nm. As a result of the coat layers being prevented from having an excessively large thickness, the amount of nitrogen atoms present in surfaces of the resin particles can be prevented from exceeding an appropriate level. Thus, adsorption of moisture on the surfaces of the resin particles can be prevented, and consequently adsorption of moisture on surfaces of the toner particles can be prevented. It is therefore possible to prevent the amount of moisture adsorbed onto the surfaces of the toner particles from exceeding an appropriate level even if the toner according to the present embodiment is used in image formation continued over a long period of time in a high temperature and high humidity environment. As a result, according to the present embodiment, it is possible to provide a positively chargeable toner that shows excellent charge stability even when subjected to image formation continued over a long period of time in a high temperature and high humidity environment.

Some toners are provided with external additive particles coated with a melamine resin in order to improve positive chargeability thereof. However, the use of a melamine resin for formation of coat layers may result in an excessively large thickness of the coat layers. It should be noted here that a melamine resin is relatively highly hydrophilic as having nitrogen atoms in molecules thereof. Moisture is therefore easily adsorbed onto surfaces of the external additive particles having coat layers formed using a melamine resin. Naturally, moisture is easily adsorbed onto surfaces of toner particles having such external additive particles. Charge stability of a positively chargeable toner including such toner particles may be reduced when the toner is used in image formation in a high temperature and high humidity environment because an excessive amount of moisture is adsorbed onto surfaces of the toner particles. According to the present embodiment, however, the specific vinyl resin includes the constitutional unit (1-1), and therefore the coat layers can be prevented from having an excessively large thickness. It is therefore possible to prevent charge stability of the positively chargeable toner from being reduced even when the toner is used in image formation continued over a long period of time in a high temperature and high humidity environment. The following describes a preferable composition of the resin particles, and then a preferable production method of the positively chargeable toner.

[Preferable Composition of Resin Particles]

Preferably, an amount of non-ring-opened oxazoline groups in 1 g of the resin particles as measured by gas chromatography-mass spectrometry is at least 0.005 mmol/g and no greater than 5.000 mmol/g. As described above, the non-ring-opened oxazoline groups are highly positively chargeable. However, the non-ring-opened oxazoline groups are highly water-absorbing. Accordingly, charge stability of the positively chargeable toner can be effectively prevented from being reduced when the toner is used in image formation continued over a long period of time in a high temperature and high humidity environment, by controlling the degree of ring-opening of the oxazoline groups in the resin particles. More preferably, the amount of the non-ring-opened oxazoline groups in 1 g of the resin particles as measured by gas chromatography-mass spectrometry is at least 0.005 mmol/g and no greater than 3.000 mmol/g. The amount of the non-ring-opened oxazoline groups in 1 g of the resin particles can be determined according to a method described in association with examples described below or a method conforming therewith.

<Resin Mother Particle>

Resin mother particles having an excessively low acid value tend to result in insufficient progress of a reaction between carboxyl groups and oxazoline groups, making it difficult to form the coat layers. Consequently, it may be impossible to obtain a desired effect (more specifically, an effect of providing a positively chargeable toner that shows excellent charge stability even when subjected to image formation continued over a long period of time in a high temperature and high humidity environment). Resin mother particles having an excessively high acid value tend to have more unreacted carboxyl groups in surfaces thereof, allowing moisture to be easily adsorbed onto the surfaces thereof. Consequently, it may be impossible to obtain the above-described desired effect. The resin mother particles preferably have an acid value of at least 0.5 mgKOH/g, and more preferably at least 0.5 mgKOH/g and no greater than 5.0 mgKOH/g. The resin mother particles having an acid value of at least 0.5 mgKOH/g are easily obtained through the resin mother particles containing a resin having an acid value of at least 0.5 mgKOH/g. The resin mother particles having an acid value of no greater than 5.0 mgKOH/g are easily obtained through the resin mother particles containing a resin having an acid value of no greater than 5.0 mgKOH/g.

Preferably, the resin contained in the resin mother particles has no nitrogen atom in molecules thereof. In this way, the amount of nitrogen atoms present in the surfaces of the resin mother particles can be prevented from exceeding an appropriate level, and consequently adsorption of moisture on the surfaces of the resin mother particles can be prevented. Thus, adsorption of moisture on the surfaces of the resin particles can be effectively prevented, and consequently adsorption of moisture on the surfaces of the toner particles can be effectively prevented. Accordingly, charge stability of the positively chargeable toner can be effectively prevented from being reduced when the toner is used in image formation continued over a long period of time in a high temperature and high humidity environment. More preferably, the resin contained in the resin mother particles has an acid value of at least 0.5 mgKOH/g and no greater than 5.0 mgKOH/g, and has no nitrogen atom in molecules thereof.

Preferably, the resin mother particles have a number average primary particle diameter of at least 80 nm and no greater than 120 nm. As a result, the resin particles tend to have a number average primary particle diameter of at least 80 nm and no greater than 120 nm. In a situation in which the external additive further includes a plurality of small-diameter particles, therefore, the small-diameter particles can be prevented from being buried in the toner mother particles. The small-diameter particles have a smaller number average primary particle diameter than the resin particles, and include at least one selected from the group consisting of silica particles and metal oxide particles. For example, in a situation in which the small-diameter particles are silica particles, the silica particles are prevented from being buried in the toner mother particles, and therefore fluidity of the toner is easily ensured. For another example, in a situation in which the small-diameter particles are titanium oxide particles, the titanium oxide particles are prevented from being buried in the toner mother particles, and therefore chargeability of the toner is ensured effectively. Thus, the resin mother particles having a number average primary particle diameter of at least 80 nm and no greater than 120 nm tend to give the toner a longer life. More preferably, the resin mother particles have a number average primary particle diameter of at least 80 nm and no greater than 85 nm. As a result, the resin particles tend to have a number average primary particle diameter of at least 80 nm and no greater than 85 nm.

<Coat Layer>

Each of the coat layers covers at least a portion of the surface of the corresponding resin mother particle. The coat layers contain the specific vinyl resin. Preferably, the coat layer contains only the specific vinyl resin.

The specific vinyl resin includes the constitutional unit (1-1) and the constitutional unit (1-2). Both of the constitutional unit (1-1) and the constitutional unit (1-2) are derived from a compound represented by formula (1-3) shown below (referred to below as a "vinyl compound (1-3)"). The specific vinyl resin may further include a constitutional unit derived from another vinyl compound (a different vinyl compound) that is not the vinyl compound (1-3). Preferably, the different vinyl compound is at least one vinyl compound selected from the group consisting of styrene-based monomers and acrylic acid-based monomers. In a situation in which the different vinyl compound is an alkyl (meth)acrylate, for example, the specific vinyl resin includes a constitutional unit represented by formula (1-4) shown below in addition to the constitutional units (1-1) and (1-2).

(1-3)

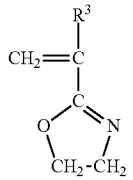

In formula (1-3), $R^3$ represents a hydrogen atom or an alkyl group optionally substituted with a substituent. The alkyl group may be a straight chain alkyl group, a branched chain alkyl group, or a ring alkyl group. The alkyl group optionally substituted with a substituent is for example a phenyl group. Preferably, $R^3$ represents a hydrogen atom, a methyl group, an ethyl group, or an isopropyl group.

(1-4)

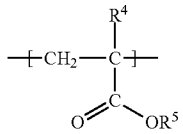

In formula (1-4), $R^4$ represents a hydrogen atom or a methyl group. In a situation in which the different vinyl compound is an alkyl acrylate, $R^4$ represents a hydrogen atom. In a situation in which the different vinyl compound is an alkyl methacrylate, $R^4$ represents a methyl group. $R^5$ represents an alkyl group optionally substituted with a substituent. The alkyl group may be a straight chain alkyl group, a branched chain alkyl group, or a ring alkyl group. Preferably, $R^5$ represents an alkyl group having a carbon number of at least 1 and no greater than 8. More preferably, $R^5$ represents a methyl group, an ethyl group, an n-propyl group, an isopropyl group, an n-butyl group, an isobutyl group, a 2-ethylhexyl group, a hydroxyethyl group, a hydroxypropyl group, or a hydroxybutyl group.

Preferably, the coat layers have a thickness of no greater than 3.0 nm. The thickness of the coat layers tends to decrease with a decrease in the acid value of the resin mother particles. For example, the coat layers tend to have a thickness of no greater than 3.0 nm when the resin mother particles have an acid value of no greater than 5.0 mgKOH/g. More preferably, the coat layers have a thickness of at least 0.1 nm and no greater than 3.0 nm. The thickness of the coat layers can be measured according to a method described in association with the examples described below or a method conforming therewith.

[Preferable Production Method of Positively Chargeable Toner According to Present Embodiment]

Preferably, a method for producing the positively chargeable toner according to the present embodiment includes resin particle preparation and external additive addition. More preferably, the method further includes toner mother particle preparation. Toner particles that are prepared at the same time are thought to have substantially the same structure as one another.

<Resin Particle Preparation>

Preferably, the resin particle preparation includes a resin mother particle preparation process, a coat liquid preparation process, and a coat layer formation process. The following describes a preferable method of resin particle preparation with reference to FIGURE. FIGURE schematically illustrates a process in the method of resin particle preparation. More specifically, FIGURE schematically illustrates the coat layer formation process. More specifically, FIGURE illustrates a reaction between one carboxyl group and one oxazoline group. Note that FIGURE illustrates chemical structures using skeletal formulae.

(Resin Mother Particle Preparation Process)

In the resin mother particle preparation process, first, a dispersion containing a plurality of resin mother particles 111 (a dispersion of the resin mother particles 111) is prepared. Each of the resin mother particles 111 has carboxyl groups in a surface thereof. More specifically, a monomer for synthesizing a resin to be contained in the resin mother particles 111 is caused to undergo polymerization (preferably, emulsion polymerization) in an aqueous medium. The monomer may be caused to undergo polymerization in the presence of a polymerization initiator. The number average primary particle diameter of the resin mother particles 111 tends to increase with an increase in the time of the polymerization of the monomer. The number average primary particle diameter of the resin mother particles 111 tends to decrease with a decrease in the time of the polymerization of the monomer.

Preferably, the aqueous medium is water or a dispersion medium containing water as a main component. As the aqueous medium, the water is preferably ion exchanged water or pure water. The dispersion medium containing water as a main component is preferably a liquid mixture of a surfactant and water or a liquid mixture of an emulsifier and water.

Next, the resin mother particles 111 are collected from the dispersion of the resin mother particles 111. Preferably, the collected resin mother particles 111 are not dried.

(Coat Liquid Preparation Process)

In the coat liquid preparation process, a solution containing a coating vinyl resin 113 (a solution of the coating vinyl resin 113) is prepared. The coating vinyl resin 113 includes the constitutional unit (1-2). "EPOCROS (registered Japanese trademark) WS-300" or "EPOCROS WS-700", product of Nippon Shokubai Co., Ltd., is for example usable as the solution of the coating vinyl resin 113. EPOCROS WS-300 contains a copolymer (water-soluble cross-linking agent) of 2-vinyl-2-oxazoline and methyl methacrylate. The monomers forming the copolymer are in a mass ratio of (2-vinyl-2-oxazoline):(methyl methacrylate)=9:1. EPOCROS WS-700 contains a copolymer (water-soluble cross-linking agent) of 2-vinyl-2-oxazoline, methyl methacrylate, and butyl acrylate. The monomers forming the copolymer are in a mass ratio of (2-vinyl-2-oxazoline):(methyl methacrylate):(butyl acrylate)=5:4:1. The monomer 2-vinyl-2-oxazoline is equivalent to the vinyl compound (1-3) in which $R^3$ is a hydrogen atom.

(Coat Layer Formation Process)

In the coat layer formation process, coat layers 13 are formed. More specifically, the resin mother particles (preferably, non-dried resin mother particles) 111 and the solution of the coating vinyl resin 113 are mixed at a specific temperature. The specific temperature is higher than or equal to a temperature at which carboxyl groups (carboxyl groups present in the surfaces of the resin mother particles 111) react with oxazoline groups (oxazoline groups in the coating vinyl resin 113) to form amide bonds 21. Through the mixing, the coat layers 13 are formed, and thus a dispersion of resin particles 10 is obtained. The thus obtained dispersion of the resin particles 10 is subjected to solid-liquid separation, washing, and drying. As a result, the resin particles 10 are obtained. Each of the thus obtained resin particles 10 includes a resin mother particle 11 and a coat layer 13 covering at least a portion of the surface of the resin mother particle 11.

Specifically, first, the resin mother particles 111 and the solution of the coating vinyl resin 113 are mixed to obtain a dispersion. The material for formation of the coat layers 13 (coat material) adheres to the surfaces of the resin mother particles 111 in the dispersion. In order that the coat material adheres to the surfaces of the resin mother particles 111 in a uniform manner, a high degree of dispersion of the resin mother particles 111 is preferably achieved in the dispersion. In order to achieve a high degree of dispersion of the resin mother particles 111 in the dispersion, a surfactant may be added to the dispersion, or the dispersion may be stirred using a powerful stirrer (for example, "Hivis Disper Mix", product of PRIMIX Corporation).

Next, the dispersion is heated up to the specific temperature at a specific heating rate under stirring. Thereafter, the dispersion is kept at the specific temperature for a specific period of time under stirring. The specific temperature is higher than or equal to the temperature at which the carboxyl groups react with the oxazoline groups to form the amide bonds 21. It is therefore thought that the following reaction proceeds while the dispersion is kept at the specific temperature. That is, some of the oxazoline groups in the coating vinyl resin 113 react with the carboxyl groups to be ring-opened. Through the above, the amide bonds 21 are formed. That is, the constitutional unit (1-1) is formed. Some of the oxazoline groups in the coating vinyl resin 113 do not react with carboxyl groups, and accordingly are not ring-opened (formation of the constitutional unit (1-2)). The presence of the amide bonds 21 can be confirmed according to a method described in association with the examples described below or a method conforming therewith.

Preferably, the specific temperature is selected from a range of from 50° C. to 100° C. The specific temperature being at least 50° C. promotes the reaction between the carboxyl groups and the oxazoline groups. The specific temperature being no greater than 100° C. prevents melting of any of resin components in the course of the formation of the coat layers 13. The resin components include the resin contained in the resin mother particles 111 and the coating vinyl resin 113.

Preferably, the specific heating rate is for example selected from a range of from 0.1° C./minute to 3° C./minute. Preferably, the specific period of time is for example selected from a range of from 30 minutes to 5 hours. Preferably, the dispersion is stirred at a rotational speed of at least 50 rpm and no greater than 500 rpm. These conditions facilitate the reaction between the carboxyl groups and the oxazoline groups.

More preferably, the dispersion is heated up to the specific temperature at the specific heating rate in the absence of a polymerization initiator. Accordingly, the carboxyl groups react with the oxazoline groups in the absence of a polymerization initiator. Thus, the coat layers 13 are easily prevented from having an excessively large thickness. For example, the coat layers 13 tend to have a thickness of no greater than 3.0 nm. Through the above, the preferable method of preparation of the resin particles 10 has been described with reference to FIGURE. The following describes the toner mother particle preparation and the external additive addition without referring to FIGURE.

<Toner Mother Particle Preparation>

In the toner mother particle preparation, capsule toner mother particles may be prepared or non-capsule toner mother particles may be prepared. In the case of production of a non-capsule toner, preferably, the toner mother particles are prepared according to a known pulverization method or a known aggregation method. These methods allow easy preparation of the toner mother particles.

<External Additive Addition>

In the external additive addition, the toner mother particles and an external additive are mixed using a mixer (for example, an FM mixer, product of Nippon Coke & Engineering Co., Ltd.). The external additive includes a plurality of resin particles. Preferably, the external additive further includes a plurality of small-diameter particles. Through the mixing, the external additive adheres to the surfaces of the toner mother particles. As described above, a positively chargeable toner including a plurality of toner particles is obtained.

[Examples of Materials of Positively Chargeable Toner]

The toner includes a plurality of toner particles. Each of the toner particles includes a toner mother particle and an external additive.

<Toner Mother Particle>

A binder resin is typically a main component (for example, at least 85% by mass) of the toner mother particles. Accordingly, properties of the binder resin are thought to have a great influence on overall properties of the toner mother particles. Properties (specific examples include hydroxyl value, acid value, Tg, and Tm) of the binder resin can be adjusted by using different resins in combination for the binder resin. The toner mother particles have a higher tendency to be anionic in a situation in which the binder resin has, for example, an ester group, a hydroxyl group, an ether group, an acid group, or a methyl group.

The toner mother particles may further contain at least one of a colorant, a releasing agent, and a charge control agent. The following describes the components in order.

(Binder Resin)

The binder resin includes a polyester resin as a main component. The binder resin may be composed only of a polyester resin or may further include a thermoplastic resin other than the polyester resin. Examples of thermoplastic resins other than the polyester resin include styrene-based resins, acrylic acid-based resins, olefin-based resins, vinyl resins, polyamide resins, and urethane resins. Examples of acrylic acid-based resins that can be used include acrylic acid ester polymers and methacrylic acid ester polymers. Examples of olefin-based resins include polyethylene resins and polypropylene resins. Examples of vinyl resins include vinyl chloride resins, polyvinyl alcohols, vinyl ether resins, and N-vinyl resins. Furthermore, copolymers of the resins listed above, that is, copolymers obtained through incorporation of a repeating unit into any of the resins listed above may be used as a thermoplastic resin for forming the toner mother particles. For example, styrene-acrylic acid-based resins and styrene-butadiene-based resins are also usable as thermoplastic resins for forming the binder resin. The following describes a polyester resin in detail.

(Polyester Resin)

The polyester resin is a copolymer of at least one alcohol and at least one carboxylic acid. Examples of alcohols that can be used in synthesis of the polyester resin include di-, tri-, and higher-hydric alcohols shown below. Examples of dihydric alcohols that can be used include diols and bisphenols. Examples of carboxylic acids that can be used in synthesis of the polyester resin include di-, tri-, and higher-basic carboxylic acids shown below.

Examples of preferable diols include aliphatic diols. Examples of preferable aliphatic diols include diethylene glycol, triethylene glycol, neopentyl glycol, 1,2-propanediol, α,ω-alkanediols, 2-butene-1,4-diol, 1,4-cyclohexanedimethanol, dipropylene glycol, polyethylene glycol, polypropylene glycol, and polytetramethylene glycol. Examples of preferable α,ω-alkanediols include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids, α,ω-alkane dicarboxylic acids, unsaturated dicarboxylic acids, and cycloalkane dicarboxylic acids. Examples of preferable aromatic dicarboxylic acids include phthalic acid, terephthalic acid, and isophthalic acid. Examples of preferable α,ω-alkane dicarboxylic acids include malonic acid, succinic acid, adipic acid, suberic acid, azelaic acid, sebacic acid, and 1,10-decanedicarboxylic acid. Examples of preferable unsaturated dicarboxylic acids include maleic acid, fumaric acid, citraconic acid, itaconic acid, and glutaconic acid. Examples of preferable cycloalkane dicarboxylic acids include cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Colorant)

A known pigment or dye matching a color of the positively chargeable toner can be used as a colorant. In order to form high-quality images using the positively chargeable toner, the toner mother particles preferably contain at least 1 part by mass and no greater than 20 parts by mass of a colorant relative to 100 parts by mass of the binder resin.

The toner mother particles may contain a black colorant. Carbon black can for example be used as a black colorant. Alternatively, a colorant that is adjusted to a black color using a yellow colorant, a magenta colorant, and a cyan colorant can be used as a black colorant.

The toner mother particles may contain a non-black colorant such as a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and acrylamide compounds. Examples of yellow colorants that can be used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example at least one compound selected from the group consisting of copper phthalocyanine compounds, anthraquinone compounds, and basic dye lake compounds. Examples of cyan colorants that can be used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The releasing agent is for example used in order to improve fixability or hot offset resistance of the positively chargeable toner. In order to increase cationic strength of the toner mother particles, it is preferable to prepare the toner mother particles using a cationic wax.

Examples of preferable releasing agents include aliphatic hydrocarbon waxes, plant waxes, animal waxes, mineral waxes, waxes having a fatty acid ester as a main component, and waxes in which a part or all of a fatty acid ester has been deoxidized. Examples of preferable aliphatic hydrocarbon waxes include low molecular weight polyethylene, low molecular weight polypropylene, polyolefin copolymer, polyolefin wax, microcrystalline wax, paraffin wax, and Fischer-Tropsch wax. Aliphatic hydrocarbon waxes include oxides thereof. Examples of preferable plant waxes include candelilla wax, carnauba wax, Japan wax, jojoba wax, and rice wax. Examples of preferable animal waxes include beeswax, lanolin, and spermaceti. Examples of preferable mineral waxes include ozocerite, ceresin, and petrolatum. Examples of preferable waxes having a fatty acid ester as a main component include montanic acid ester wax and castor wax. One wax may be used independently, or two or more waxes may be used in combination.

(Charge Control Agent)

The charge control agent is for example used in order to improve charge stability or a charge rise characteristic of the positively chargeable toner. The charge rise characteristic of the positively chargeable toner is an indicator as to whether the positively chargeable toner can be charged to a specific charge level in a short period of time. The cationic strength of the toner mother particles can be increased through the toner mother particles containing a positively chargeable charge control agent.

<External Additive>

(Resin Particle)

An amount of the resin particles is preferably at least 0.5 parts by mass and no greater than 5.0 parts by mass relative to 100.0 parts by mass of the toner mother particles. In a situation in which the external additive includes two or more types of resin particles, a total amount of the resin particles is preferably at least 0.5 parts by mass and no greater than 5.0 parts by mass relative to 100.0 parts by mass of the toner mother particles.

The preferable composition of the resin particles is as described in [Preferable Composition of Resin Particles] above. The following describes a resin contained in the resin mother particles in detail.

Preferably, the resin contained in the resin mother particles has an acid value of at least 0.5 mgKOH/g and no greater than 5.0 mgKOH/g, and has no nitrogen atom in molecules thereof. More specifically, the resin contained in the resin mother particles is preferably at least one selected from the group consisting of polyester resins having an acid value of at least 0.5 mgKOH/g and no greater than 5.0 mgKOH/g and styrene-acrylic acid-based resins having an acid value of at least 0.5 mgKOH/g and no greater than 5.0 mgKOH/g. Monomers that are used to synthesize the polyester resin are as described in (Polyester Resin) above. Monomers that are used to synthesize the styrene-acrylic acid-based resin are as follows.

The styrene-acrylic acid-based resin is a copolymer of at least one styrene-based monomer and at least one acrylic acid-based monomer. Styrene-based monomers listed below can for example be preferably used to synthesize the styrene-acrylic acid-based resin. Acrylic acid-based monomers listed below can for example be preferably used to synthesize the styrene-acrylic acid-based resin.

Examples of preferable styrene-based monomers include styrene, alkyl styrenes, hydroxystyrenes, and halogenated styrenes. Examples of preferable alkyl styrenes include α-methylstyrene, m-methylstyrene, p-methylstyrene, p-ethylstyrene, and 4-tert-butylstyrene. Examples of preferable hydroxystyrenes include p-hydroxystyrene and m-hydroxystyrene. Examples of preferable halogenated styrenes include α-chlorostyrene, o-chlorostyrene, m-chlorostyrene, and p-chlorostyrene.

Examples of preferable acrylic acid-based monomers include (meth)acrylic acid, (meth)acrylonitrile, alkyl (meth) acrylates, and hydroxyalkyl (meth)acrylates. Examples of preferable alkyl (meth)acrylates include methyl (meth)acrylate, ethyl (meth)acrylate, n-propyl (meth)acrylate, iso-propyl (meth)acrylate, n-butyl (meth)acrylate, iso-butyl (meth) acrylate, and 2-ethylhexyl (meth)acrylate. Examples of preferable hydroxyalkyl (meth)acrylates include 2-hydroxyethyl (meth)acrylate, 3-hydroxypropyl (meth)acrylate, 2-hydroxypropyl (meth)acrylate, and 4-hydroxybutyl (meth) acrylate.

(Small-Diameter Particle)

Preferably, the external additive further includes a plurality of small-diameter particles. Preferably, the small-diameter particles are silica particles or particles of a metal oxide. Examples of preferable metal oxides include alumina, titanium oxide, magnesium oxide, zinc oxide, strontium titanate, and barium titanate. The external additive may include one type of small-diameter particles, or two or more types of small-diameter particles.

An amount of the small-diameter particles is preferably at least 0.5 parts by mass and no greater than 10.0 parts by mass relative to 100.0 parts by mass of the toner mother particles. In a situation in which the external additive includes two or more types of small-diameter particles, a total amount of the small-diameter particles is preferably at least 0.5 parts by mass and no greater than 10.0 parts by mass relative to 100.0 parts by mass of the toner mother particles. Preferably, a number average primary particle diameter of the small-diameter particles is no greater than 0.5 times the number average primary particle diameter of the resin particles. For example, the number average primary particle diameter of the small-diameter particles is at least 5 nm and no greater than 30 nm.

Examples

The following describes Examples of the present disclosure. Table 1 shows compositions of toners according to Examples and Comparative Examples. "Non-ring-opened group amount" in Table 1 indicates an amount of non-ring-opened oxazoline groups in 1 g of the resin particles. "Particle diameter" indicates the number average primary particle diameter of the resin mother particles.

TABLE 1

| | Resin particle | | | | | |
|---|---|---|---|---|---|---|
| | | | Resin mother particle | | | |
| Toner | Type | Non-ring-opened group amount (mmol/g) | Type | Particle diameter (nm) | Acid value (mgKOH/g) | Coat layer Thickness (nm) |
| TA-1 | E-1 | 0.032 | P-1 | 80 | 3.7 | 1.8 |
| TA-2 | E-2 | 0.063 | P-2 | 82 | 0.6 | 0.3 |
| TA-3 | E-3 | 0.012 | P-3 | 80 | 4.8 | 2.3 |
| TA-4 | E-4 | 0.031 | P-4 | 85 | 3.9 | 2.1 |
| TA-5 | E-5 | 1.023 | P-1 | 80 | 3.7 | 1.9 |
| TB-1 | E-6 | 0.002 | P-5 | 81 | 0.0 | 0.0 |

Table 2 shows compositions of resin particles according to Examples and Comparative Examples. "St" in Table 2 means styrene. "MMA" means methyl methacrylate. "AA" means acrylic acid. "DVB" means divinylbenzene. "WS-300" means "EPOCROS WS-300", product of Nippon Shokubai Co., Ltd. "EPOCROS WS-300", product of Nippon Shokubai Co., Ltd., has a solids content of 10% by mass. "WS-700" means "EPOCROS WS-700", product of Nippon Shokubai Co., Ltd. "EPOCROS WS-700", product of Nippon Shokubai Co., Ltd., has a solids content of 25% by mass.

TABLE 2

| | Amount (g) | | | | | |
|---|---|---|---|---|---|---|
| | Resin mother particle | | | | Coat liquid | |
| Resin particle | St | MMA | AA | DVB | WS-300 | WS-700 |
| E-1 | 135.0 | 0.0 | 5.0 | 7.0 | 0.0 | 15.0 |
| E-2 | 138.0 | 0.0 | 0.5 | 7.0 | 0.0 | 15.0 |
| E-3 | 130.0 | 0.0 | 10.0 | 7.0 | 0.0 | 15.0 |
| E-4 | 100.0 | 35.0 | 5.0 | 7.0 | 0.0 | 15.0 |
| E-5 | 135.0 | 0.0 | 5.0 | 7.0 | 15.0 | 0.0 |
| E-6 | 140.0 | 0.0 | 0.0 | 7.0 | 0.0 | 15.0 |

The following first describes, in order, preparation methods and physical property measurement methods of the resin particles (more specifically, resin particles E-1 to E-6)

according to Examples and Comparative Examples. The following next describes, in order, production methods, physical property measurement methods, evaluation methods, and evaluation results of the positively chargeable toners according to Examples and Comparative Examples (more specifically, toners TA-1 to TA-5 and TB-1). In evaluations in which errors might occur, an evaluation value was calculated by obtaining an appropriate number of measured values and calculating the arithmetic mean of the measured values in order to ensure that any errors were sufficiently small.

[Preparation Method of Resin Particles]

<Preparation of Resin Particles E-1>

A round-bottomed flask (capacity: 1 L) equipped with an anchor type stirring impeller was charged with 135.0 g of styrene, 5.0 g of acrylic acid, 7.0 g of divinylbenzene, 10.0 g of potassium peroxodisulfate (a water-soluble polymerization initiator), 8.0 g of "Tween 20" (ingredient: polyoxyethylene sorbitan monolaurate) produced by Tokyo Chemical Industry Co., Ltd., and 375.0 g of ion exchanged water. The internal temperature of the flask was increased up to 70° C. at a heating rate of 1° C./minute while the flask contents were stirred at a rotational speed of 100 rpm. The flask contents were stirred at a rotational speed of 100 rpm for 8 hours while the internal temperature of the flask was kept at 70° C. The flask contents underwent a reaction (emulsion polymerization) while the internal temperature of the flask was kept at 70° C. Through the above, a dispersion of resin mother particles was obtained. The thus obtained dispersion was subjected to centrifugation at a rotational speed of 10,000 rpm for 30 minutes using a centrifuge ("micro refrigerated centrifuge 3740", product of KUBOTA Corporation). Through the above, a plurality of resin mother particles P-1 were obtained. The thus obtained resin mother particles P-1 were not dried.

Another round-bottomed flask (capacity: 1 L) equipped with an anchor type stirring impeller was charged with all the above-obtained resin mother particles (non-dried resin mother particles) P-1, 15 g of an aqueous solution of an oxazoline group-containing polymer ("EPOCROS WS-700", product of Nippon Shokubai Co., Ltd., solids content: 25% by mass), and 500 g of ion exchanged water. The flask contents were adjusted to pH 4.0 through addition of dilute hydrochloric acid to the flask. The internal temperature of the flask was increased up to 70° C. at a heating rate of 1° C./minute while the flask contents were stirred at a rotational speed of 100 rpm. The flask contents were stirred at a rotational speed of 100 rpm for 3 hours while the internal temperature of the flask was kept at 70° C. Carboxyl groups in the resin mother particles P-1 reacted with oxazoline groups in the aqueous solution of the oxazoline group-containing polymer while the internal temperature of the flask was kept at 70° C. Thereafter, the internal temperature of the flask was decreased to room temperature. Through the above, a dispersion containing resin particles was obtained.

The thus obtained dispersion was subjected to suction filtration using a Buchner funnel. The resultant solid was re-dispersed in ion exchanged water. The resultant dispersion was subjected to suction filtration using a Buchner funnel. The above-described solid-liquid separation was repeated five times. The resultant solid was dried to yield an agglomerate of a plurality of resin particles. The resultant agglomerate was pulverized at a pulverization pressure of 0.6 MPa using a supersonic jet pulverizer ("jet mill IDS-2", product of Nippon Pneumatic Mfg. Co., Ltd.). A flat ceramic plate was used as an impact plate in the pulverization. Through the above, a plurality of resin particles E-1 were obtained.

<Preparation of Resin Particles E-2>

The amount of styrene was changed to 138.0 g. The amount of acrylic acid was changed to 0.5 g. The amount of potassium peroxodisulfate was changed to 8.0 g. Resin mother particles P-2 were obtained according to the same method as the preparation method of the resin mother particles P-1 in all aspects other than the above-described changes. Resin particles E-2 were obtained according to the same method as the preparation method of the resin particles E-1 in all aspects other than that the resin mother particles P-2 were used.

<Preparation of Resin Particles E-3>

The amount of styrene was changed to 130.0 g. The amount of acrylic acid was changed to 10.0 g. The amount of "Tween 20" produced by Tokyo Chemical Industry Co., Ltd. was changed to 2.0 g. Resin mother particles P-3 were obtained according to the same method as the preparation method of the resin mother particles P-1 in all aspects other than the above-described changes. Resin particles E-3 were obtained according to the same method as the preparation method of the resin particles E-1 in all aspects other than that the resin mother particles P-3 were used.

<Preparation of Resin Particles E-4>

A round-bottomed flask (capacity: 1 L) equipped with an anchor type stirring impeller was charged with 100.0 g of styrene, 35.0 g of methyl methacrylate, 5.0 g of acrylic acid, 7.0 g of divinylbenzene, 10.0 g of potassium peroxodisulfate (a water-soluble polymerization initiator), 8.0 g of "Tween 20" (ingredient: polyoxyethylene sorbitan monolaurate) produced by Tokyo Chemical Industry Co., Ltd., and 375.0 g of ion exchanged water. Resin mother particles P-4 were obtained according to the same method as the preparation method of the resin mother particles P-1 in all aspects other than the above-described changes. Resin particles E-4 were obtained according to the same method as the preparation method of the resin particles E-1 in all aspects other than that the resin mother particles P-4 were used.

<Preparation of Resin Particles E-5>

"EPOCROS WS-300" (solids content: 10% by mass), product of Nippon Shokubai Co., Ltd., was used as an aqueous solution of an oxazoline group-containing polymer. Resin particles E-5 were obtained according to the same method as the preparation method of the resin particles E-1 in all aspects other than the above-described change.

<Preparation of Resin Particles E-6>

A round-bottomed flask (capacity: 1 L) equipped with an anchor type stirring impeller was charged with 140.0 g of styrene, 7.0 g of divinylbenzene, 5.0 g of potassium peroxodisulfate (a water-soluble polymerization initiator), 8.0 g of "Tween 20" (ingredient: polyoxyethylene sorbitan monolaurate) produced by Tokyo Chemical Industry Co., Ltd., and 375.0 g of ion exchanged water. Resin mother particles P-5 were obtained according to the same method as the preparation method of the resin mother particles P-1 in all aspects other than the above-described changes. Resin particles E-6 were obtained according to the same method as the preparation method of the resin particles E-1 in all aspects other than that the resin mother particles P-5 were used.

[Physical Property Measurement Method of Resin Particles]

<Measurement of Acid Value of Resin Mother Particles>

With respect to each of the resin mother particles P-1 to P-5, some of the resin mother particles were dried to obtain a measurement sample. The measurement sample was used to determine the acid value of the resin mother particles according to a method described in "JIS K0070-1992".

Specifically, 20 g of the measurement sample was added into a conical flask. Into the conical flask, 100 mL of a solvent and a few drops of a phenolphthalein solution (an indicator) were added. A liquid mixture of diethyl ether and ethanol [diethyl ether:ethanol=2:1 (volume ratio)] was used as the solvent.

The measurement sample was dissolved in the solvent by shaking the conical flask in a water bath. The liquid in the conical flask was titrated using a 0.1 mol/L solution of potassium hydroxide in ethanol. The acid value (unit: mgKOH/g) was calculated from a result of the titration in accordance with the following equation (equation 1). Table 1 shows the calculation result.

$$\text{Acid value}=(B\times f1\times 5.611)/W1 \quad \text{(equation 1)}$$

In (equation 1), "B" represents the amount (mL) of the 0.1 mol/L solution of potassium hydroxide in ethanol used in the titration. "f1" represents a factor of the 0.1 mol/L solution of potassium hydroxide in ethanol. "W1" represents the mass (g) of the measurement sample. The number "5.611" is equivalent to the formula weight "56.11×(1/10)" of potassium hydroxide.

Note that the factor (f1) was calculated according to the following method. A conical flask was charged with 25 mL of 0.1 mol/L hydrochloric acid. The phenolphthalein solution was added into the conical flask. The liquid in the conical flask was titrated using the 0.1 mol/L solution of potassium hydroxide in ethanol. The factor (f1) was calculated from an amount of the 0.1 mol/L solution of potassium hydroxide in ethanol required for neutralization.

<Measurement of Number Average Primary Particle Diameter of Resin Mother Particles and Measurement of Coat Layer Thickness of Resin Mother Particles>

With respect to each of the resin mother particles P-1 to P-5, the number average primary particle diameter of the resin mother particles was measured according to the following method. Specifically, with respect to each of the resin mother particles P-1 to P-5, a transmission electron microscope (TEM, "H-7100FA", product of Hitachi High-Technologies Corporation) was used to observe the resin mother particles at a magnification of 1,000,000×, and TEM images of more than 100 resin mother particles were captured. TEM images of 100 resin mother particles were randomly selected from among the captured TEM images. With respect to each of the randomly selected TEM images, an equivalent circle diameter of the resin mother particle was measured using image analysis software ("WinROOF", product of Mitani Corporation), and a number average of the thus measured values of the equivalent circle diameter was calculated. The calculated number average was taken to be a number average primary particle diameter of the resin mother particles. Table 1 shows the calculation result.

The thickness of the coat layers of the resin mother particles was measured according to the following method. Specifically, with respect to each of the resin particles E-1 to E-6, a transmission electron microscope (TEM, "H-7100FA", product of Hitachi High-Technologies Corporation) was used to observe the resin particles at a magnification of 1,000,000×, and TEM images of more than 100 resin particles were captured. TEM images of 100 resin particles were randomly selected from among the captured TEM images. With respect to each of the randomly selected TEM images, a thickness of the coat layer of the resin particle was determined using image analysis software ("WinROOF", product of Mitani Corporation). A number average of the thus determined values of the thickness of the coat layers was calculated, and the calculated number average was taken to be a "coat layer thickness". Table 1 shows the calculation result.

[Production Method of Positively Chargeable Toners]

<Production of Toner TA-1>

An FM mixer ("FM-20B", product of Nippon Coke & Engineering Co., Ltd.) was used to mix 89.0 parts by mass of a polyester resin ("TUFTONE (registered Japanese trademark) NE-410", product of Kao Corporation), 5.0 parts by mass of carbon black ("REGAL (registered Japanese trademark) 330R", product of Cabot Corporation), 5.0 parts by mass of a polypropylene wax ("VISCOL (registered Japanese trademark) 660P", product of Sanyo Chemical Industries, Ltd.), and 1.0 part by mass of a quaternary ammonium salt ("BONTRON (registered Japanese trademark) P-51", product of ORIENT CHEMICAL INDUSTRIES, Co., Ltd.). The resultant mixture was melt-kneaded using a twin-screw extruder ("PCM-30", product of Ikegai Corp.) under conditions of a material feeding rate of 6 kg/hour, a shaft rotational speed of 160 rpm, and a temperature (cylinder temperature) set at 150° C. The resultant melt-kneaded product was cooled. After cooling, the melt-kneaded product was coarsely pulverized using a pulverizer ("ROTOPLEX (registered Japanese trademark)", product of Hosokawa Micron Corporation). The resultant coarsely pulverized product was finely pulverized using a pulverizer ("Turbo Mill Type RS", product of FREUND-TURBO CORPORATION). The resultant finely pulverized product was classified using a classifier ("Elbow Jet Type EJ-LABO", product of Nittetsu Mining Co., Ltd.). As a result, toner mother particles having a volume median diameter ($D_{50}$) of 7.0 μm were obtained.

An FM mixer ("FM-10B", product of Nippon Coke & Engineering Co., Ltd.) was charged with 97.3 parts by mass of the toner mother particles, 1.0 part by mass of the resin particles E-1, 0.7 parts by mass of hydrophobic silica particles ("AEROSIL (registered Japanese trademark) RA-200H", product of Nippon Aerosil Co., Ltd.), and 1.0 part by mass of conductive titanium oxide particles ("EC-100", product of Titan Kogyo, Ltd.). The toner mother particles, the resin particles E-1, the hydrophobic silica particles, and the conductive titanium oxide particles were mixed under conditions of a rotational speed of 3,500 rpm, a jacket temperature of 20° C., and a treatment time of 5 minutes. Thus, the toner TA-1 including a plurality of toner particles was obtained.

<Production Method of Toners TA-2 to TA-5 and TB-1>

The toners TA-2 to TA-5 and TB-1 were obtained according to the same method as the production method of the toner TA-1 in all aspects other than that the resin particles E-2 to E-6 were used, respectively.

[Physical Property Measurement Method of Positively Chargeable Toners]

<Measurement Method of Non-Ring-Opened Oxazoline Group Amount>

An aqueous solution (concentration: 2% by mass) of a nonionic surfactant ("EMULGEN (registered Japanese trademark) 120", product of Kao Corporation, ingredient: polyoxyethylene lauryl ether) was diluted tenfold with water to prepare an aqueous surfactant solution. With respect to each of the positively chargeable toners TA-1 to TA-5 and TB-1, 10 g of the positively chargeable toner was dispersed in 500 mL of the aqueous surfactant solution obtained as described above to obtain a toner dispersion.

The thus obtained toner dispersion was subjected to sonication using an ultrasonic disperser ("Mini Ultrasonic Welder P128", product of Ultrasonic Engineering Co., Ltd., output: 100 W, oscillatory frequency: 28 kHz) to separate the external additive from the toner mother particles. Subsequently, the thus collected external additive was subjected to re-slurring through addition of ion exchanged water and suction filtration three times to obtain an evaluation external additive.

Next, quantitative determination was performed on the evaluation external additive obtained as described above by gas chromatography-mass spectrometry (GC/MS). A gas chromatograph mass spectrometer ("GCMS-QP2010 Ultra", product of Shimadzu Corporation) and a multi-shot pyrolyzer ("FRONTIER LAB MULTI-FUNCTIONAL PYROLYZER (registered Japanese trademark) PY-3030D", product of Frontier Laboratories Ltd.) were used as measuring devices in the GC/MS. A GC column ("AGILENT (registered Japanese trademark) J&W Ultra-inert Capillary GC Column DB-5 ms", product of Agilent Technologies Japan, Ltd., phase: allylene phase having a polymer main chain strengthened by introducing allylene to siloxane polymer, inner diameter: 0.25 mm, film thickness: 0.25 μm, length: 30 m) was used.

(Gas Chromatography)

Carrier gas: Helium (He) gas

Carrier flow rate: 1 mL/minute

Vaporizing chamber temperature: 210° C.

Thermal decomposition temperature: 600° C. in heating furnace, 320° C. in interface portion Heating condition: Temperature kept at 40° C. for 3 minutes, increased from 40° C. to 300° C. at a rate of 10° C./minute, and kept at 300° C. for 15 minutes (Mass Spectrometry)

Ionization method: Electron impact (EI) method

Ion source temperature: 200° C.

Interface portion temperature: 320° C.

Detection mode: Scan (measurement range: from 45 m/z to 500 m/z)

A mass spectrum was measured under the above-specified conditions and analyzed to determine a styrene-derived peak area and a non-ring-opened oxazoline group-derived peak area. The amount of the resin particles (more specifically, the corresponding one of the resin particles E-1 to E-6) was determined from the styrene-derived peak area. The amount of the non-ring-opened oxazoline groups was determined from the non-ring-opened oxazoline group-derived peak area. Based on the data obtained as described above, the amount of non-ring-opened oxazoline groups in 1 g of the resin particles was calculated. Table 1 shows the calculation result. Standard substances were used in the quantitative determination. The above-mentioned "peak areas" each mean a chromatogram peak area.

[Evaluation Method of Positively Chargeable Toners]

<Method for Confirming Presence of Amide Bonds>

The presence or absence of amide bonds (more specifically, amide bonds obtained through a reaction between carboxyl groups and oxazoline groups) was confirmed according to the following method. More specifically, an evaluation external additive was obtained according to the method described in <Measurement Method of Non-ring-opened Oxazoline Group Amount> above. The resultant evaluation external additive was added to 1 mL of deuterated chloroform to obtain a solution. Solids remaining undissolved in the deuterated chloroform (more specifically, hydrophobic silica particles and conductive titanium oxide particles in the evaluation external additive) were removed from the solution. The resultant deuterated chloroform solution was put in a test tube (diameter: 5 mm). The test tube was placed in a Fourier transform nuclear magnetic resonance (FT-NMR) apparatus ("JNM-AL400", product of JEOL Ltd.). A $^{1}$H-NMR spectrum was measured under conditions of a sample temperature of 20° C. and a number of times of accumulation of 128. Tetramethylsilane was used as an internal standard substance for calibrating chemical shift. When a triplet signal was observed around a chemical shift δ of 6.5 in the measured $^{1}$H-NMR spectrum, it was presumed that the above-described amide bonds were present.

The presence of the above-described amide bonds was confirmed in the evaluation external additives obtained using the respective toners TA-1 to TA-5. The presence of the above-described amide bonds was not confirmed in the evaluation external additive obtained using the toner TB-1.

<Evaluation of Toner Charge Amount, Image Density, and Toner Scattering Amount>

(Preparation of Evaluation Sample)

With respect to each of the positively chargeable toners TA-1 to TA-5 and TB-1A, 100 parts by mass of a carrier (carrier for "TASKalfa 8002i", product of KYOCERA Document Solutions Inc.) and 10 parts by mass of the positively chargeable toner were mixed over 30 minutes using a ball mill. Thus, an evaluation sample was obtained.

(Preparation of Evaluation Apparatus)

A multifunction peripheral ("TASKalfa 8002i", product of KYOCERA Document Solutions Inc.) was prepared. The evaluation sample (unused) was loaded into a developing device of the multifunction peripheral, and a toner for replenishment use (unused) was loaded into a toner container of the multifunction peripheral. In the examples, the same toner as the toner included in the evaluation sample was used as the toner for replenishment use. That is, the toner for replenishment use was one of the toners TA-1 to TA-5 and TB-1. An evaluation apparatus was prepared as described above.

(Measurement of Toner Charge Amount, Image Density, and Toner Scattering Amount)

An image (coverage: 5%) was printed on 10,000 successive sheets of plain paper (A4 size) using the evaluation apparatus under environmental conditions of a temperature of 28° C. and a relative humidity of 80% (a high temperature and high humidity environment). Thereafter, a first evaluation image was printed on plain paper (A4 size) using the evaluation apparatus under environmental conditions of a temperature of 28° C. and a relative humidity of 80%. The first evaluation image included a solid image portion and a blank portion (a region not printed on). Thereafter, the amount of charge of the toner was measured according to a method described below, and the thus measured value was taken to be a "toner charge amount after 10,000-sheet printing". The image density of the first evaluation image was also measured according to a method described below, and the thus measured value was taken to be an "image density after 10,000-sheet printing". Furthermore, the amount of toner scattering was measured according to a method described below, and the thus measured value was taken to be a "toner scattering amount after 10,000-sheet printing".

The same image (coverage: 5%) was printed on 300,000 successive sheets of plain paper (A4 size) using the evaluation apparatus under environmental conditions of a temperature of 28° C. and a relative humidity of 80% (a high temperature and high humidity environment). Thereafter, a second evaluation image was printed on plain paper (A4 size) using the evaluation apparatus under environmental conditions of a temperature of 28° C. and a relative humidity of 80%. The second evaluation image included a solid image portion and a blank portion (a region not printed on). Thereafter, the amount of charge of the toner was measured according to a method described below, and the thus measured value was taken to be a "toner charge amount after 300,000-sheet printing". The image density of the second evaluation image was also measured according to a method described below, and the thus measured value was taken to be an "image density after 300,000-sheet printing". Furthermore, the amount of toner scattering was measured according to a method described below, and the thus measured value was taken to be a "toner scattering amount after 300,000-sheet printing".

The following describes the method for measuring the toner charge amount. First, the evaluation sample was taken out of the development device of the evaluation apparatus. Next, 0.10 g of the evaluation sample (more specifically, the two-component developer) was put into a measurement cell of a Q/m meter ("MODEL 210HS-1", product of TREK, INC.), and only the toner in the evaluation sample was sucked through a sieve (metal mesh) for 10 seconds. The toner charge amount (unit: μC/g) was calculated in accordance with an equation shown below.

Toner charge amount (unit: μC/g)=total amount of electricity of sucked toner (unit: μC)/mass of sucked toner (unit: g)

The following describes the method for measuring image density. A reflection density (ID: image density) of the solid image portion of the first evaluation image was measured using a Macbeth reflection densitometer ("RD914", product of X-Rite Inc.). A reflection density (ID: image density) of the solid image portion of the second evaluation image was also measured using a Macbeth reflection densitometer ("RD914", product of X-Rite Inc.).

The following describes the method for measuring the amount of toner scattering. The mass of toner recovered from the inside of the evaluation apparatus was measured using an electronic balance ("GF-3000", product of A&D Company, Limited). More specifically, the evaluation apparatus further included a suction fan and a recovery container. The suction fan was located around a development roller of the development device. The suction fan was a device for sucking toner failing to sufficiently adhere to a development roller (for example, scattering toner). The recovery container was connected to the suction fan. The recovery container was a container for recovering the toner sucked by the suction fan. The mass of the recovered toner in the recovery container was measured using the electronic balance.

The toner charge amount was evaluated in accordance with the following evaluation standard. Tables 3 and 4 show the evaluation result.

Good: A toner charge amount of at least 12.0 μC/g and no greater than 35.0 μC/g

Not good: A toner charge amount of less than 12.0 μC/g or greater than 35.0 μC/g The image density was evaluated in accordance with the following evaluation standard. Tables 3 and 4 show the evaluation result.

Good: An image density of at least 1.10

Not Good: An image density of less than 1.10

The toner scattering amount was evaluated in accordance with the following evaluation standard. Tables 3 and 4 show the evaluation result.

Good: A toner scattering amount of no greater than 100 g

Not good: A toner scattering amount of greater than 100 g

[Evaluation Results of Positively Chargeable Toners]

Table 3 shows the results of the evaluations of the toner charge amount, the image density, and the toner scattering amount after the 10,000-sheet printing. Table 4 shows the results of the evaluations of the toner charge amount, the image density, and the toner scattering amount after the 300,000-sheet printing. In Tables 3 and 4, (G) means good, and (NG) means not good.

TABLE 3

| | | After 10,000-sheet printing | | |
|---|---|---|---|---|
| | Toner | Toner charge amount (μC/g) | Image density | Toner scattering amount (g) |
| Example 1 | TA-1 | 29.5 (G) | 1.32 (G) | 0.02 (G) |
| Example 2 | TA-2 | 22.2 (G) | 1.30 (G) | 0.12 (G) |
| Example 3 | TA-3 | 32.5 (G) | 1.22 (G) | 0.02 (G) |
| Example 4 | TA-4 | 28.3 (G) | 1.31 (G) | 0.01 (G) |
| Example 5 | TA-5 | 27.5 (G) | 1.28 (G) | 0.05 (G) |
| Comparative Example 1 | TB-1 | 18.5 (G) | 1.28 (G) | 1.24 (G) |

TABLE 4

| | | After 300,000-sheet printing | | |
|---|---|---|---|---|
| | Toner | Toner charge amount (μC/g) | Image density | Toner scattering amount (g) |
| Example 1 | TA-1 | 28.4 (G) | 1.28 (G) | 0.90 (G) |
| Example 2 | TA-2 | 18.4 (G) | 1.15 (G) | 58.40 (G) |
| Example 3 | TA-3 | 28.6 (G) | 1.25 (G) | 1.30 (G) |
| Example 4 | TA-4 | 25.2 (G) | 1.29 (G) | 6.50 (G) |
| Example 5 | TA-5 | 27.4 (G) | 1.26 (G) | 32.60 (G) |
| Comparative Example 1 | TB-1 | 11.5 (NG) | 1.05 (NG) | 158.2 (NG) |

The toners TA-1 to TA-5 (the toners according to Examples 1 to 5) each had the above-described basic features. Specifically, the toners TA-1 to TA-5 each included a plurality of toner particles. Each of the toner particles included a toner mother particle and an external additive adhering to a surface of the toner mother particle. The external additive included a plurality of resin particles. Each of the resin particles had a resin mother particle and a coat layer covering at least a portion of a surface of the resin mother particle. The coat layer contained the specific vinyl resin.

With respect to each of the toners TA-1 to TA-5, as shown in Tables 3 and 4, the toner charge amount was successfully maintained within the desired range, the image density was successfully maintained at a value greater than or equal to the desired value, and the toner scattering amount was successfully restricted to a value lower than or equal to the desired value even after the 300,000-sheet printing in the high temperature and high humidity environment using the toner.

By contrast, the toner TB-1 did not have the above-described basic features. Specifically, the resin mother particles of the toner TB-1 (the toner according to Comparative Example 1) had an acid value of 0.0 mgKOH/g. With respect to the toner TB-1, the toner charge amount was below the desired range, the image density was below the desired value, and the toner scattering amount was above the desired value after the 300,000-sheet printing using the toner.

The resin particles E-1 to E-6 each had a different coat layer thickness. It is thought that such a result was obtained for the following reasons. Specifically, the resin mother particles (more specifically, each of the resin mother particles P-1 to P-5) of each of the resin particles E-1 to E-4 and E-6 had a different acid value. Accordingly, the resin mother particles P-1 to P-5 each had a different number of oxazoline group-reactive sites in the surfaces thereof. Consequently, the resin particles E-1 to E-4 and E-6 each had a different coat layer thickness. An oxazoline group-containing polymer having a different composition was used for each of the resin particles E-1 and E-5. Consequently, the resin particles E-1 and E-5 each had a slightly different coat layer thickness.

Since the resin mother particles P-5 had an acid value of 0.0 mgKOH/g, the surfaces of the resin mother particles P-5 had no oxazoline group-reactive site. Therefore, the oxazoline group-containing polymer used in the preparation of the resin particles E-6 was not fixed to the surfaces of the resin mother particles P-5, and consequently no coat layer was formed.

What is claimed is:

1. A positively chargeable toner comprising a plurality of toner particles, wherein each of the toner particles includes a toner mother particle and an external additive adhering to a surface of the toner mother particle, the external additive includes a plurality of resin particles, each of the resin particles has a resin mother particle and a coat layer covering at least a portion of a surface of the resin mother particle, the coat layer contains a vinyl resin, and the vinyl resin includes a constitutional unit represented by formula (1-1) shown below and a constitutional unit represented by formula (1-2) shown below, (1-1)

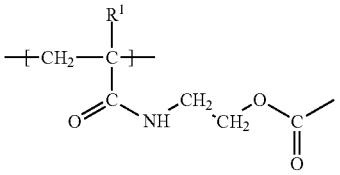

where $R^1$ in formula (1-1) represents a hydrogen atom or an alkyl group optionally substituted with a substituent, an available bond of a carbon atom bonded to two oxygen atoms in formula (1-1) is bonded to an atom forming a resin contained in the resin mother particles, and (1-2)

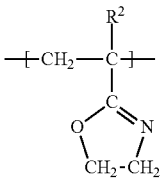

$R^2$ in formula (1-2) represents a hydrogen atom or an alkyl group optionally substituted with a substituent.

2. The positively chargeable toner according to claim 1, wherein the coat layer has a thickness of no greater than 3.0 nm.

3. The positively chargeable toner according to claim 1, wherein the resin contained in the resin mother particles has no nitrogen atom in molecules thereof.

4. The positively chargeable toner according to claim 1, wherein the resin contained in the resin mother particles has an acid value of at least 0.5 mgKOH/g.

5. The positively chargeable toner according to claim 1, wherein an amount of non-ring-opened oxazoline groups in 1 g of the resin particles as measured by gas chromatography-mass spectrometry is at least 0.005 mmol/g and no greater than 5.000 mmol/g.

6. The positively chargeable toner according to claim 1, wherein the resin particles have a number average primary particle diameter of at least 80 nm and no greater than 120 nm, and the external additive includes at least one selected from the group consisting of silica particles having a smaller number average primary particle diameter than the resin particles and metal oxide particles having a smaller number average primary particle diameter than the resin particles.

7. The positively chargeable toner according to claim 1, wherein the vinyl resin further includes a constitutional unit represented by formula (1-4) shown below, (1-4)

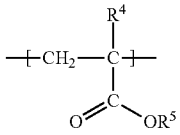

where in formula (1-4), $R^4$ represents a hydrogen atom or a methyl group, and $R^5$ represents an alkyl group optionally substituted with a substituent.

8. The positively chargeable toner according to claim 3, wherein the resin contained in the resin mother particles is at least one selected from the group consisting of polyester resins having an acid value of at least 0.5 mgKOH/g and no greater than 5.0 mgKOH/g and styrene-acrylic acid-based resins having an acid value of at least 0.5 mgKOH/g and no greater than 5.0 mgKOH/g.

9. The positively chargeable toner according to claim 3, wherein the resin contained in the resin mother particles is a cross-linked styrene-acrylic acid-based resin, and the resin mother particles have a number average primary particle diameter of at least 80 nm and no greater than 85 nm.

* * * * *